US007344414B2

(12) United States Patent
Kuo

(10) Patent No.: US 7,344,414 B2
(45) Date of Patent: Mar. 18, 2008

(54) POWER CONNECTOR HAVING REGULATING MEMBER

(75) Inventor: Peter Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/455,958

(22) Filed: Jun. 20, 2006

(65) Prior Publication Data

US 2006/0290329 A1 Dec. 28, 2006

(30) Foreign Application Priority Data

Jun. 22, 2005 (CN) ..... 2005 2 0073042

(51) Int. Cl.
*H01R 13/66* (2006.01)

(52) U.S. Cl. ..... 439/620.04; 439/620.01

(58) Field of Classification Search ..... 439/405, 439/607, 620.04, 620.01
See application file for complete search history.

(56) References Cited

U.S. PATENT DOCUMENTS 3,924,914 A * 12/1975 Banner ..... 439/105
5,087,212 A * 2/1992 Hanami ..... 439/620.04
6,753,755 B2 * 6/2004 Montague ..... 337/265
6,793,535 B2 * 9/2004 Beideman ..... 439/620.04

* cited by examiner

*Primary Examiner*—Tho D. Ta
*Assistant Examiner*—Travis Chambers
(74) *Attorney, Agent, or Firm*—Wei Te Chung

(57) ABSTRACT

A power connector (100) includes a dielectric housing (1) defining a number of passages (14) therein, first and second terminals (21, 22) received in the corresponding passages for power transmission, a detecting terminal (20) received in the corresponding passage for signal transmission and a regulating member (4) with specified constant voltage electrically connecting with the detecting terminal for being detected by a complementary connector by detecting the detecting terminal. The first and second terminals respectively served as a positive pole and a negative pole of the power connector.

18 Claims, 6 Drawing Sheets

POWER CONNECTOR HAVING REGULATING MEMBER

BACKGROUND OF THE INVENTION

1. Field of the Invention

The present invention relates to an electrical connector, and more particularly to a power connector. This application relates to a copending application titled "POWER CONNECTOR WITH ID IDENTIFYING MEMBER "and having the same assignee.

2. Description of Related Art

Power jacks/plugs are widely used in the electrical industry to connect power supplies with electrical devices, such as mobile phone, note book. The power connector commonly comprises a dielectric housing, an inner contact and an outer contact respectively served as a positive pole and a negative pole of a power supply for powering electrical device connecting to the power connector, and a signal contact provided for signal transmission. The power connectors are classified in many types by specific work voltage thereof, such as 5V, 12V etc, so as to adapt for different applications. However, the appearance and outer profiles of the power connectors of different types are similar, therefore, it is possible that the user inserts an improper type power connector to a complementary connector unmatched with the power connector, which results in destroying performance and useful life of the power connector as well as an electrical component to which the complementary connector is assembled.

Hence, an improved power connector is desired to overcome the disadvantages of the related art.

SUMMARY OF THE INVENTION

Accordingly, an object of the present invention is to provide a power connector which could be identified by an electrical component to which the power connector is electrically connected.

Another object of the present invention is to provide a power connector which is able to normally work within a specified voltage range.

In order to achieve the objects set forth, a power connector in accordance with the present invention comprises a dielectric housing defining a plurality of passages therein, first and second terminals received in the corresponding passages for power transmission, a detecting terminal received in the corresponding passage for signal transmission and a regulating member with specific constant voltage electrically connecting with the detecting terminal for being detected by a complementary connector via detecting the detecting terminal. The first and second terminals respectively served as a positive pole and a negative pole of the power connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
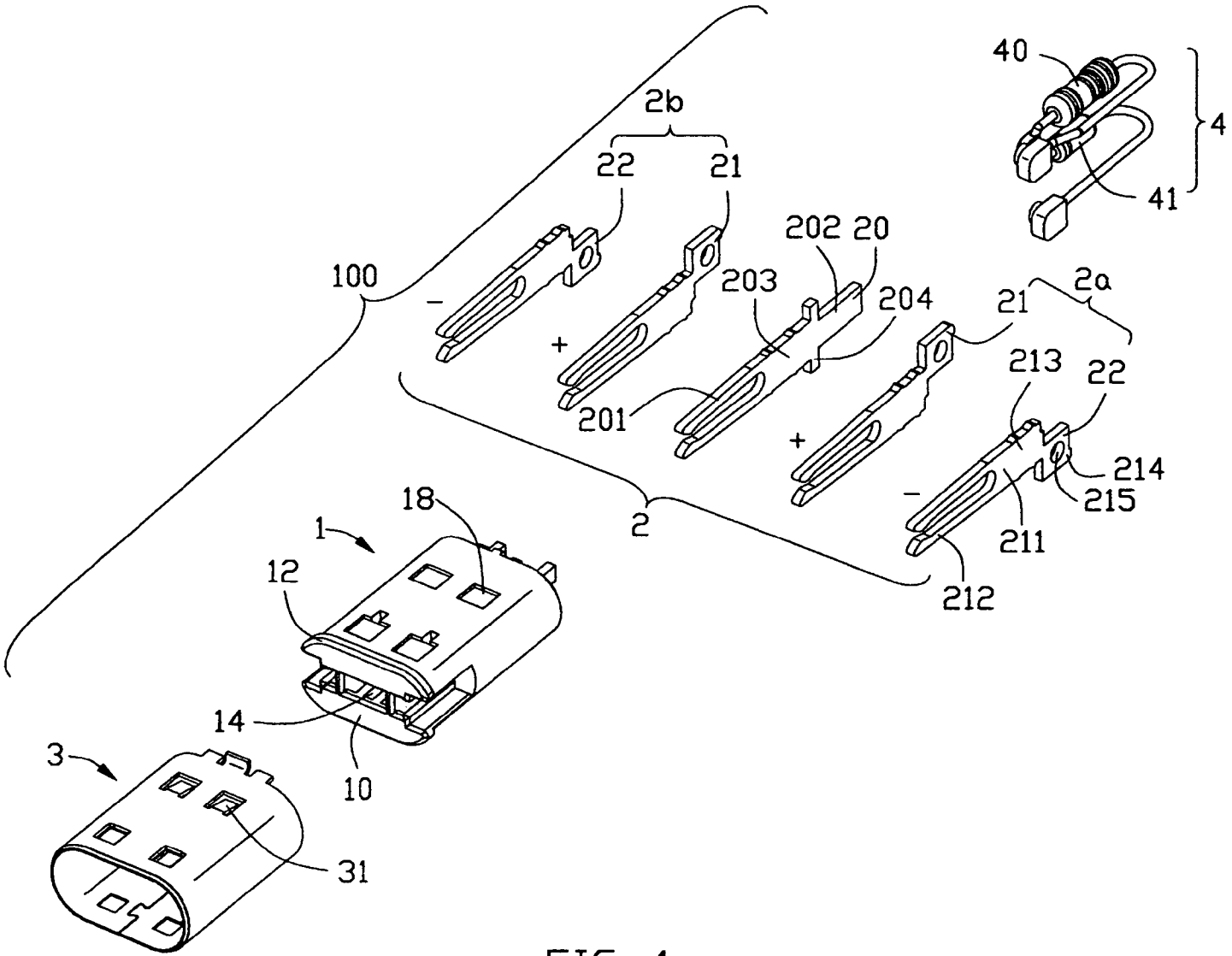
FIG. 1 is an exploded, perspective view of a power connector in accordance with the present invention.
Figure 2:
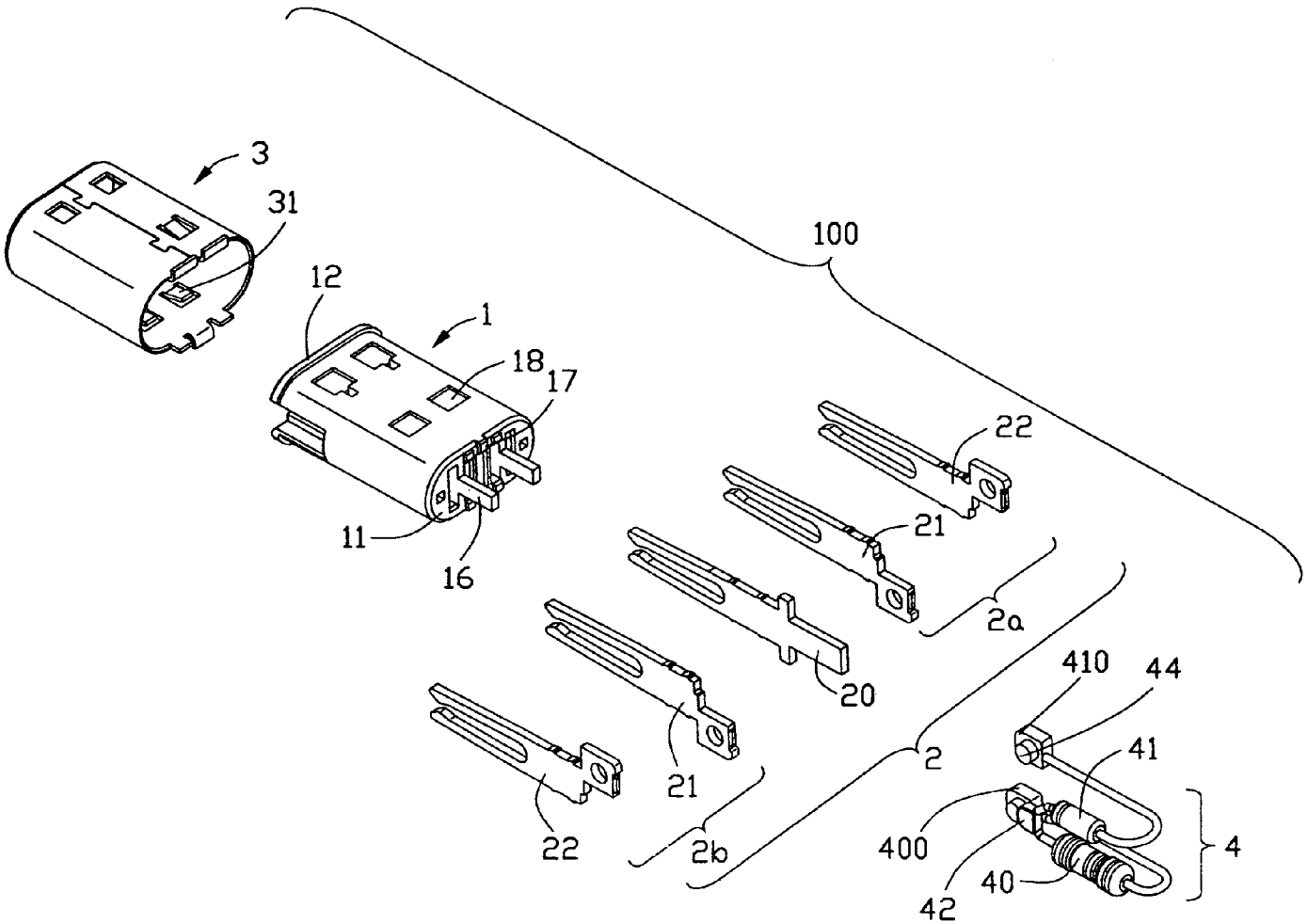
FIG. 2 is a view similar to FIG. 1, but viewed from another aspect.

Please refer to FIG. 1 and FIG. 2, the power connector 100 in accordance with the present invention comprises a dielectric housing 1, a plurality of terminals 2 received in the housing 1, a shielding shell 3 enclosing the housing 1 and a regulating member 4 electrically connecting with the terminals 2.

Continuing to FIGS. 1-2, the dielectric housing 1 defines an elliptic front face 10 and a rear face 11 opposite to the front face 10. A plurality of passages 14 are defined through the front and rear faces 10, 11. A flange 12 is formed along fringe of the front face 10. A pair of protruding portions 16 rearwardly protrudes from the rear face 11 of the housing 1. The housing 1 further forms a pair of projections 17 respectively on top and bottom sides of an opening, which is defined in the rear face 11 corresponding to the center passage 14 of the housing 1. A plurality of cutouts 18 are respectively recessed from top and bottom surfaces (not labeled) of the housing 1.

Figure 3:
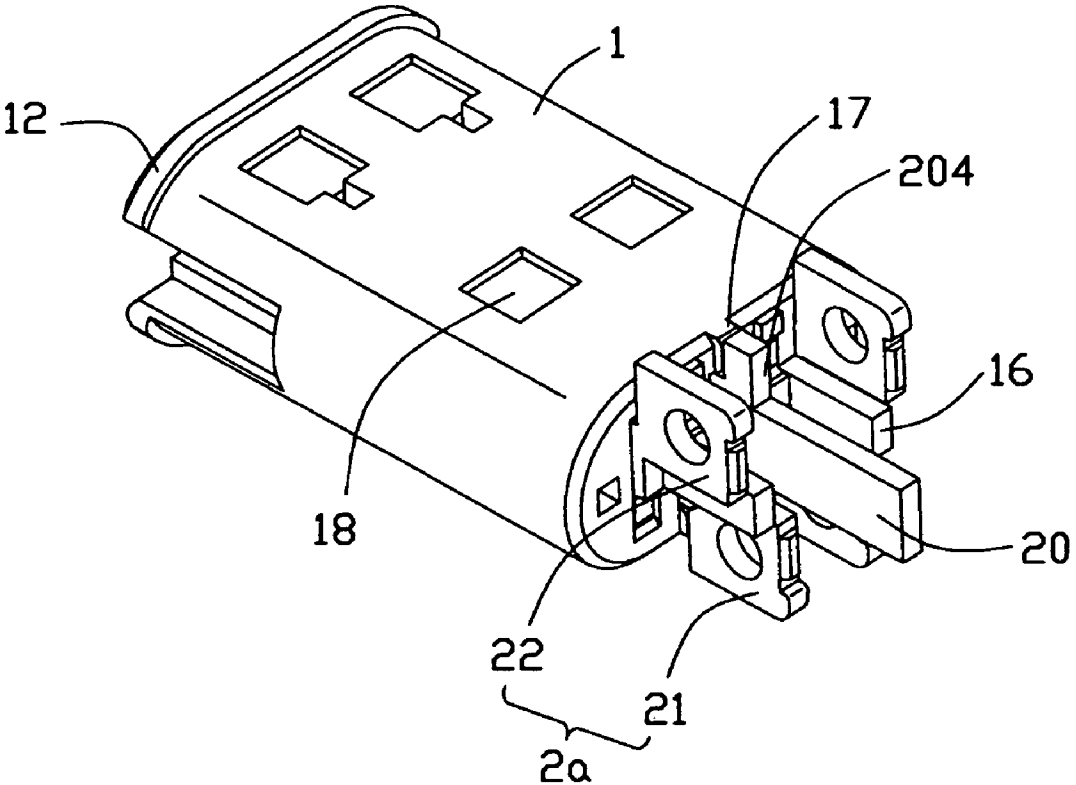
FIG. 3 is a partially assembled view of FIG. 1.
Figure 4:
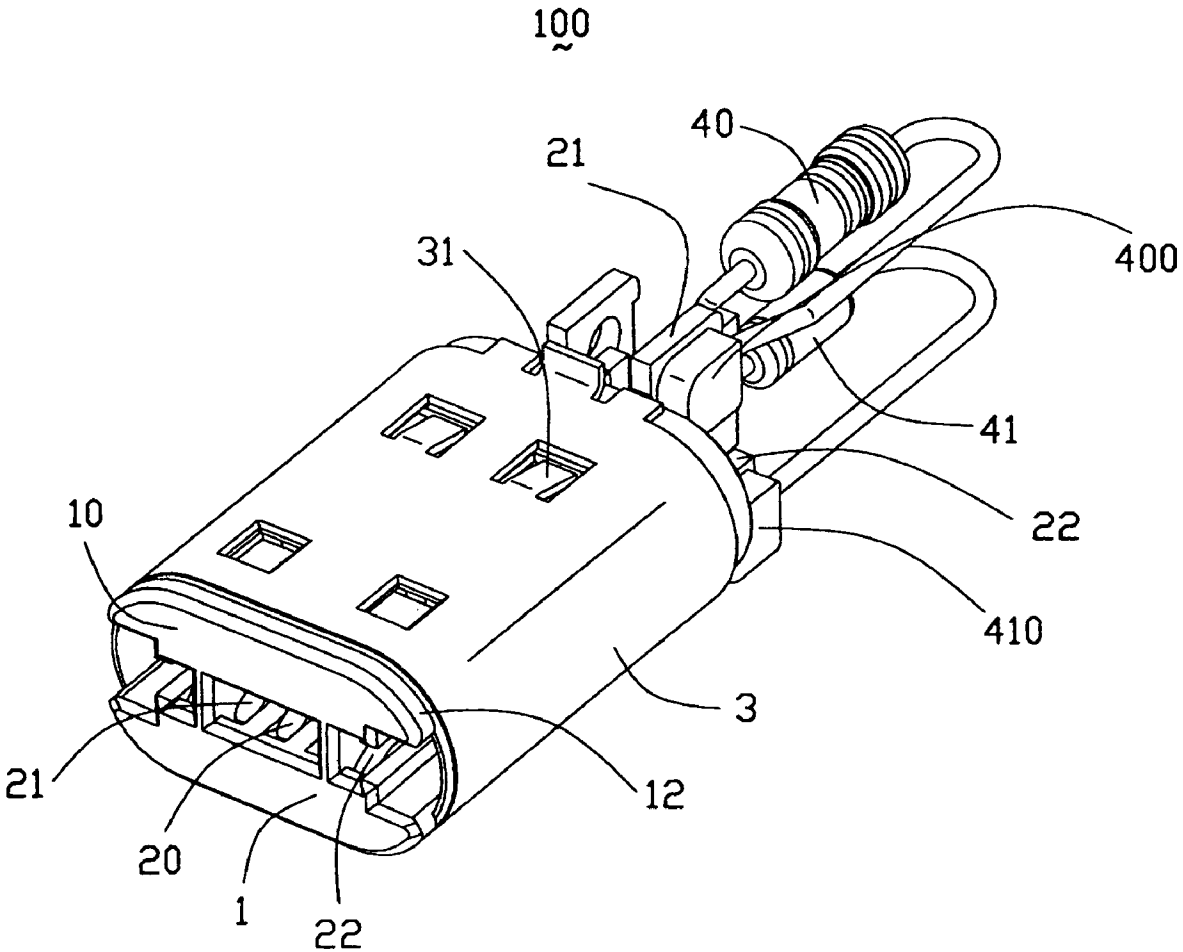
FIG. 4 is an assembled, perspective view of FIG. 1.
Figure 5:
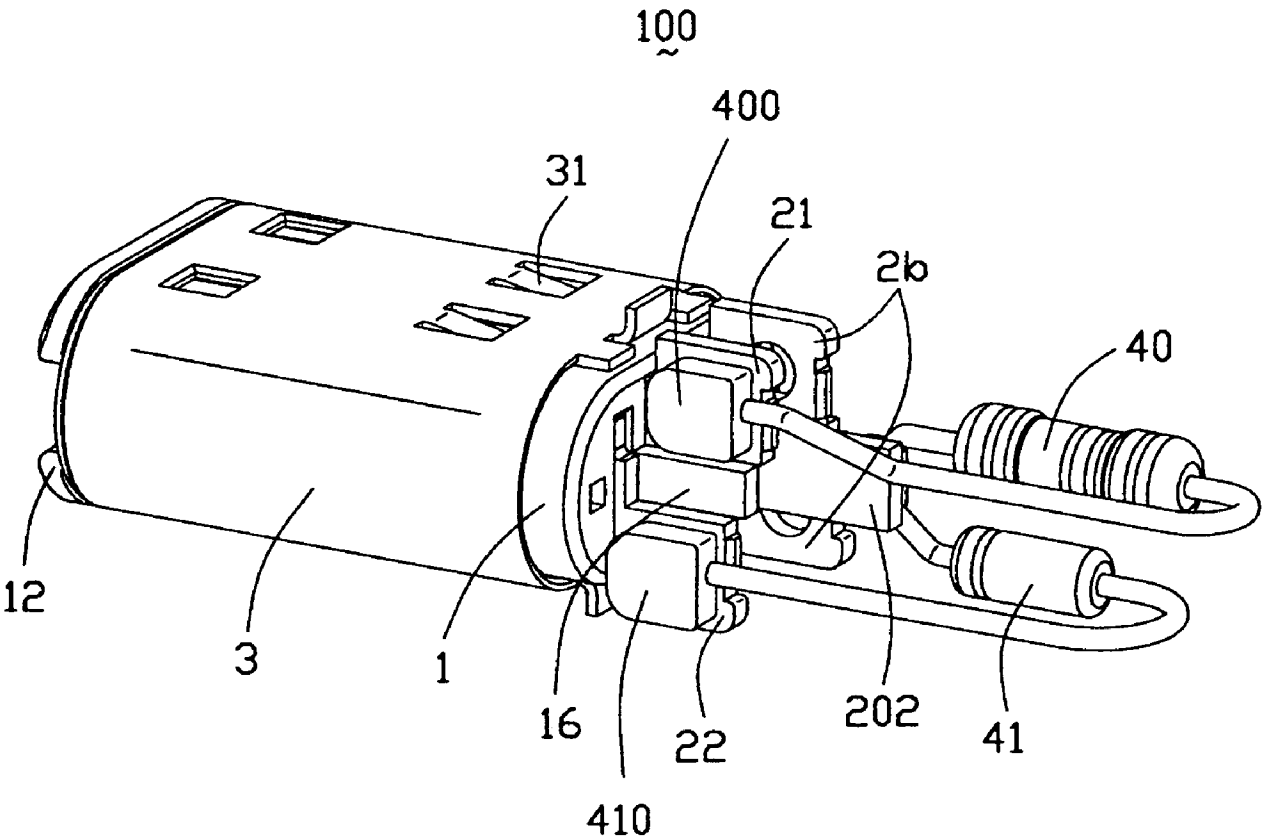
FIG. 5 is a view similar to FIG. 4, but viewed from another aspect.
Figure 6:
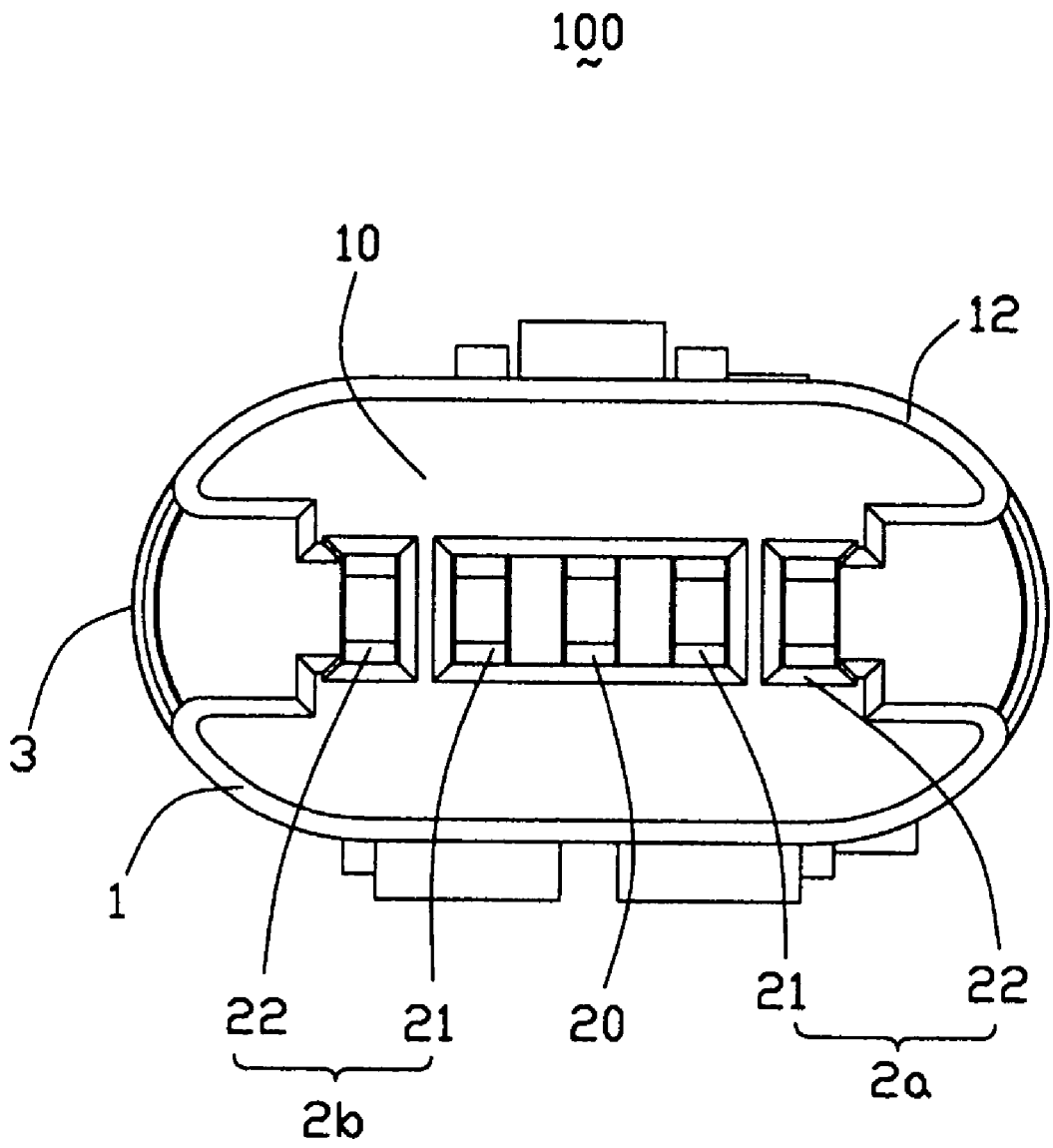
FIG. 6 is a front elevation view of FIG. 4.

Referring to FIGS. 1-3, the terminals 2 are respectively inserted into the corresponding passages 14 of the housing 1 from rear-to-front direction of the housing 1. The terminals 2 are composed of first and second terminals 21, 22 for power transmission and a detecting terminal 20 for signal transmission. The detecting terminal 20 comprises a fork-shape contacting portion 201, an opposite flat tail portion 202 extending beyond the rear face 11 of the housing 1 and a retaining portion 203 connecting the contacting portion 201 and the tail portion 202. The retaining portion 203 has a plurality of barbs (not labeled) interferencely engaging with inner side surfaces of the corresponding passage 14. The detecting terminal 20 further comprises a pair of stop portions 204 extending vertically from opposite upper and lower edges sides of the tail portion 202 to abut against the projection 17 of the housing 1 for restricting the excessive assembly of the detecting terminal 20. The first terminal 21 and the second terminal 22 have the same structure as each other, each comprises a fork-shape contacting portion 212, a rearwardly extending flat retaining portion 213 retained in corresponding passage 14 and a rearwardly, vertically extending tail portion 214. The tail portion 214 defines a through hole 215 in the center thereof for achieving well soldering effect. In the preferred embodiment, the power connector 100 comprises a pair of first terminals 21 served as the positive pole of the power supply and a pair of second terminals 22 served as the negative pole of the power supply, moreover, one first terminal 21 and one second terminal 22 form the first terminal group 2*a* being capable of power transmission while another first and second terminals 21, 22 form the second terminal group 2*b* capable of power transmission, too. The second terminal group 2*b* has no connection with other circuit trace or electrical component, such as a cable. For facilitating soldering of the terminals and the conductors of the cable, the first terminals 21 reverse 180 degree in a vertical direction relative to the second terminals 22 so as to stagger the tail portions 214 in the vertical direction, and the protruding portion 16 of the housing 1 is located between the tail portions 214.

The shielding shell 3 is made of unitary metal plate and comprises a plurality of downwardly punched tabs 31 latchably received in corresponding cutouts 18 of the housing 1. The shielding shell 3 is assembled to the dielectric housing 1 in the rear-to-front direction and sheathes over the housing 1, with the front edge thereof in contact with the flange 12 of the housing 1 to position the assembly of the shielding shell 3 and prevent forward movement of the shell 3. The shielding shell 3 defines a plurality of square apertures (not labeled) respectively engageable with corresponding portion of the complementary connector for increasing mating/unmating force of the power connector 100.

The regulating member 4 in the present invention is provided for regulating voltage of the detecting terminal 20. The regulating member 4 is composed of a resister 40 connecting with the first terminal 21 of the first terminal group 2*a* via an enlarged first connecting end 400 and a constant voltage diode 41 connecting with the second terminal 22 of the first terminal group 2*a* via an enlarged second connecting end 410, and a common connecting part 42, to which the resister 40 and the voltage diode 41 both connect, electrically connecting with the detecting terminal 20. Each of the first and second connecting ends 400, 410 and the common connecting part 42 forms a round protrusion 44 extending therefrom to insert into and are soldered with the through hole 215 of corresponding terminals 21, 22, 20 to electrically connect the components together. The voltage of the detecting terminal 20 could be customized by selecting constant diode 41 with specified constant voltage, thus makes the power connector 100 adapted for corresponding application. The resister 40 is able to reduce the electric current therethrough to let the electric current is less than or equal to rated electric current of the constant voltage diode 41, thus protecting the power connector 100 from being damaged. Moreover, the power connector 100 is able to work within a voltage range due to the electrical character of the constant voltage diode 41. From another aspect, when the power connector 100 is mated with the complementary connector, the electrical component with the complementary connector assembled thereon will detect the voltage of the detecting terminal 20 to identify whether the power connector 100 is the matching type, if not, the electrical component will not run to avoid any undesired impact.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector adapted for electrically connecting with a complementary connector, comprising:

a dielectric housing defining a plurality of passages therein;

first and second terminals received in the corresponding passages for power transmission, the first and second terminals respectively served as a positive pole and a negative pole of the power connector, each first and second terminals comprising a contacting portion adapted for electrically connecting with said complementary connector, a retaining portion rearwardly extending from the contacting portion to interferentially received in corresponding passages, and a tail portion rearwardly extending beyond the housing to electrically connect with corresponding conductors of a cable, and wherein the first terminal is reversed with 180 degrees relative to the second terminal in the dielectric housing to stagger the tail portions in the vertical direction;

a detecting terminal received in the corresponding passage for signal transmission; and a regulating member with specified constant voltage electrically connecting with the detecting terminal adapted for the specified constant voltage being detected by the complementary connector via detecting the detecting terminal.

2. The power connector as claimed in claim 1, wherein the first and second terminals are the same in configuration.

3. The power connector as claimed in claim 1, wherein the contacting portions of the first and second terminals are of fork-shape.

4. The power connector as claimed in claim 1, wherein the detecting terminal comprises a contacting portion, a retaining portion and a tail portion extending beyond the dielectric housing, and wherein the detecting terminal has a pair of stop portions located adjacent to the retaining portion thereof abutting against corresponding portion of the housing.

5. The power connector as claimed in claim 1, wherein the housing forms a rearwardly extending protruding portion, the first and second terminal respectively nearly positioned at opposite sides of the protruding portion.

6. The power connector as claimed in claim 1, wherein the housing defines a top face and a bottom face opposite to the top face, the top and bottom faces respectively defining a plurality of cutouts therein, and wherein the shielding shell has a plurality of tabs respectively engaging with the corresponding cutouts of the housing.

7. The power connector as claimed in claim 1, wherein the first terminal, the second terminal and the detecting terminal are commonly located in a same mating face of the housing for commonly connecting with said complementary connector.

8. The power connector as claimed in claim 1, wherein the regulating member comprises a resister disposed between and electrically connecting with the detecting terminal and the first terminal, and a constant voltage diode disposed between and electrically connecting with the detecting terminal and the second terminal.

9. The power connector as claimed in claim 8, wherein the resister respectively connects with a first connecting end soldered with the first terminal and a common connecting part soldered with the detecting terminal, and the voltage diode connects with a second connecting end soldered with the second terminal and said common connecting part soldered with the detecting terminal.

10. The power connector as claimed in claim 9, wherein each tail portion of the first and second terminals defines a through hole, and wherein the first and second connecting ends of the regulating member respectively define a protrusion insert into and soldered with the through hole.

11. The power connector as claimed in claim 1, wherein the power connector comprises shielding shell sheathing over the housing.

12. The power connector as claimed in claim 11, wherein the housing defines an elliptical front face and a fringe outwardly protruding from edge of the front face, and wherein the shielding shell has a front edge in contact with the fringe of the housing.

13. The power connector as claimed in claim 1, wherein the power connector comprises two first terminals and two second terminals, and one first terminal and one second terminal form a first terminal group electrically connecting with the regulating member while the rest first and second terminals form a second terminal group.

14. The power connector as claimed in claim 13, wherein the second terminal group of the power connector are left for spare.

15. The power connector as claimed in claim 13, wherein the pair of first terminals are disposed at opposite sides of the detecting terminals, and wherein the pair of second terminals are disposed at opposite sides of the pair of first terminals.

16. A power connector comprising:

first and second power contacts and a detecting contact spaced from one another; and a regulating member including opposite first and second points with an middle point therebetween, a resistor connected between the first and the middle points, and a voltage diode connected between the second and the middle points; wherein the middle point electrically connected to said detecting contact without any part intermediating therebetween and changing electrical property thereof; wherein the first contact, the second contact and the detecting contact are commonly located in a same mating face of the housing for commonly connecting with a complementary connector.

17. The power connector as claimed in claim 16, wherein said first point is electrically connected to the first power contact without any part intermediating therebetween and changing electrical property thereof, and said second point connected to the second power contact without any part intermediating therebetween and changing electrical property thereof.

18. The power connector as claimed in claim 17, wherein said regulating member defines two U-shaped configuration linked by said middle point.

* * * * *